United States Patent [19]

Shuck

[11] 4,026,356

[45] May 31, 1977

[54] METHOD FOR IN SITU GASIFICATION OF A SUBTERRANEAN COAL BED

[75] Inventor: Lowell Z. Shuck, Morgantown, W. Va.

[73] Assignee: The United States Energy Research and Development Administration, Washington, D.C.

[22] Filed: Apr. 29, 1976

[21] Appl. No.: 681,647

[52] U.S. Cl. ..... 166/259; 175/11; 166/245

[51] Int. Cl.[2] ..... E21B 43/24

[58] Field of Search ..... 166/259, 271, 256, 245; 175/11, 16; 299/2, 14

[56] References Cited

UNITED STATES PATENTS

| | | | |
|---|---|---|---|
| 2,788,956 | 4/1957 | Pevere et al. | 166/259 |
| 2,906,337 | 9/1959 | Hennig | 166/259 X |
| 3,004,594 | 10/1961 | Crawford | 166/259 |
| 3,283,814 | 11/1966 | Schlicht et al. | 166/259 X |
| 3,297,876 | 1/1967 | De Maria | 175/11 UX |
| 3,734,184 | 5/1973 | Scott | 166/259 |
| 3,775,073 | 11/1973 | Rhoades | 166/259 X |
| 3,933,447 | 1/1976 | Pasini et al. | 166/259 X |

OTHER PUBLICATIONS

Maurer, "Novel Drilling Techniques", March 1968, Pergamon Press, N. Y., N. Y., pp. 87–91.

*Primary Examiner*—Stephen J. Novosad
*Attorney, Agent, or Firm*—Dean E. Carlson; David S. Zachry; Earl L. Larcher

[57] ABSTRACT

The method of the present invention relates to providing controlled directional bores in subterranean earth formations, especially coal beds for facilitating in situ gasification operations. Boreholes penetrating the coal beds are interconnected by laser-drilled bores disposed in various arrays at selected angles to the major permeability direction in the coal bed. These laser-drilled bores are enlarged by fracturing prior to the gasification of the coal bed to facilitate the establishing of combustion zones of selected configurations in the coal bed for maximizing the efficiency of the gasification operation.

1 Claim, 5 Drawing Figures

METHOD FOR IN SITU GASIFICATION OF A SUBTERRANEAN COAL BED

Figure 1:
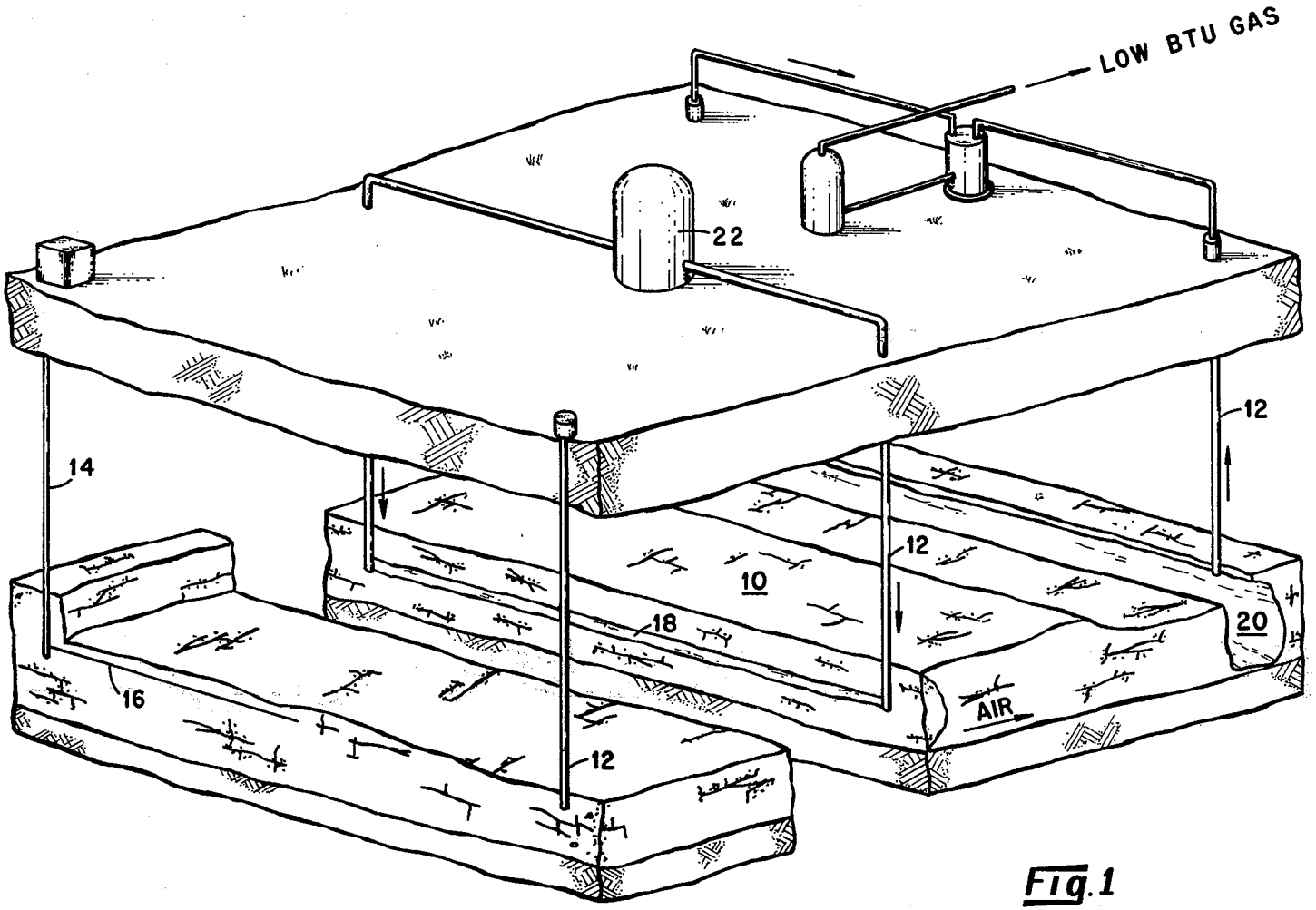

The present invention relates generally to the recovery of energy values from subterranean earth formations, and more particularly to a method of facilitating in situ gasification of subsurface coal beds by drilling elongated bores in selected direction and arrays in the coal bed for linking spaced-apart boreholes penetrating the coal bed for the purpose of establishing combustion zones of desired configurations.

In situ gasification of coal has been a subject of considerable interest for effecting the recovery of energy and chemical values present in subterranean coal beds without undergoing the considerable expense of conventional mining. Generally, in situ gasification by employing shaftless techniques involves providing access openings in the coal beds by drilling one or more boreholes in the coal bed, injecting a combustion-supporting gas into the coal bed, and then initiating the combustion of the coal for producing a product gas which is withdrawn from the coal bed through one or more selected boreholes. The product gas recovered by such in situ gasification is usually a relatively low Btu gas having a heat value in the range of about 100 to 300 Btu/ft$^3$. The lower heat values of the product gas may be obtained by using air as the combustion-supporting medium while the higher heat values may be provided by using oxygen or oxygen-rich air as the combustion-supporting medium. It may also be desirable to inject steam into the combustion zone during the gasification operation to increase the hydrogen content of the product gas.

When preparing the subterranean coal field for in situ gasification purposes, it is desirable to drill a plurality of boreholes in the coal bed and then interconnect certain of these boreholes to provide a relatively large combustion zone for facilitating efficient production of product gas. The boreholes may be linked or interconnected within the coal bed prior to the gasification operation by employing a procedure known as electrolinking so as to establish a combustion zone extending between the connected boreholes. Interconnecting such spaced-apart boreholes by employing known linking processes is slow and expensive, as well as being relatively unreliable since there is no mechanism or technique for accurately controlling the direction of the linking between boreholes. These linking problems become even more troublesome if the coal beds contain anomalies, such as natural fractures and water pockets lying in the path of the desired link. Usually, the best results obtained by employing previously known linking processes is to arrange the boreholes to be linked along a path of major permeability through the coal bed as to help ensure that the gases providing the link will most likely flow beneath the boreholes. Inasmuch as the arrangement of the boreholes used in the in situ gasification operations employing multiple boreholes is often dictated by the technique for linking certain wells for providing the combustion zone, it has been found too difficult to efficiently gasify large blocks of coal.

Accordingly, it is the primary aim or objective of the present invention to provide a method for facilitation in situ gasification of subterranean coal beds wherein a plurality of directionally oriented boreholes may be disposed in any desired locations and arrays with positive and controlled linking being established between selected boreholes to provide a combustion zone most suitable for efficiently gasifying essentially the entire or selected portions of the coal bed. This objective is achieved by penetrating the coal bed with a selected number of boreholes, interconnecting or linking selected boreholes with laser-drilled pilot bores, and then enlarging the pilot bores by fracturing so as to establish a passageway which will provide the necessary communication between the boreholes for establishing the combustion zone. The combustion-supporting gas may be passed through the coal bed from a borehole separate from the linked boreholes or this gas may be introduced at a borehole at one end of the linked boreholes so as to provide a serial flowing continuous combustion zone through the particular array of interconnected boreholes. These boreholes may be disposed in the coal bed in any selected array regardless of the orientation of the plane of maximum permeability through the coal bed or the presence of anomalies in the coal bed which would normally deter linking by employing conventional means. Thus, by being able to interconnect the boreholes in coal beds by employing various channel arrangements including those following relatively tortuous paths the gasification of the coal bed may be maximized to provide a highly efficient gas producing system.

Other and further objects of the invention will be obvious upon an understanding of the illustrative methods about to be described, or will be indicated in the appended claims, and various advantages not referred to herein will occur to one skilled in the art upon employment of the invention in practice.

Several embodiments of the invention have been chosen for the purpose of illustration and description of the subject method. The embodiments illustrated are not intended to be exhaustive or to limit the invention to the precise forms disclosed. They are chosen and described in order to best explain the principles of the subject method and their application in practical use to thereby enable others skilled in the art to best utilize the method of the invention in various modifications as are best adapted to the particular use contemplated.

Figure 2:
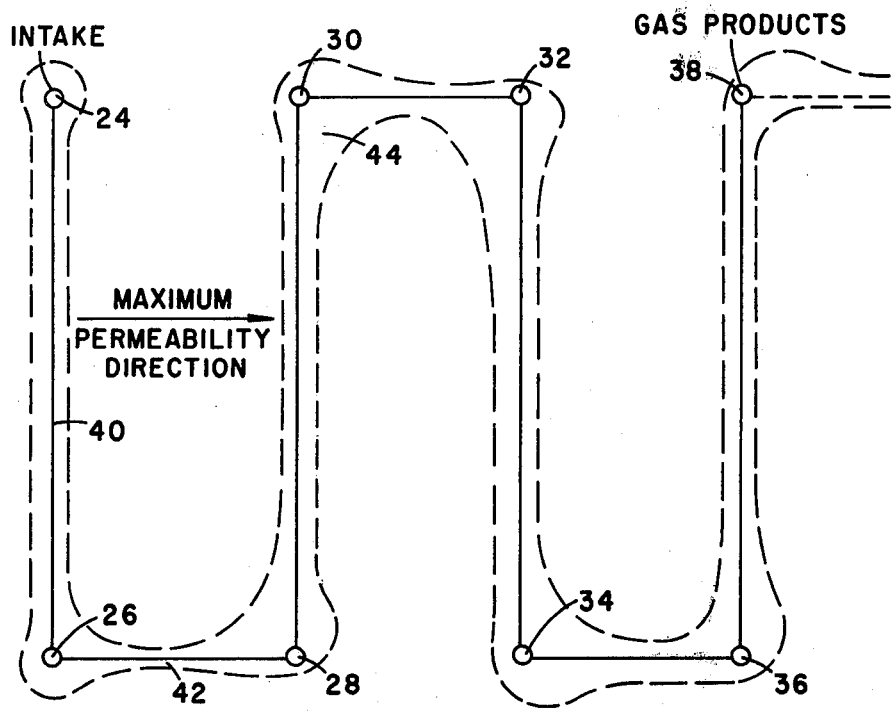
Figure 3:
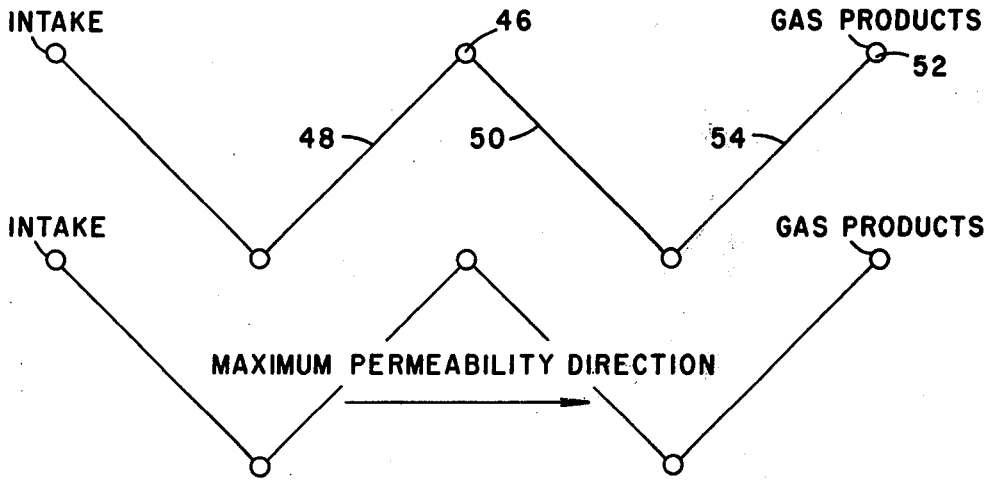
Figure 4:
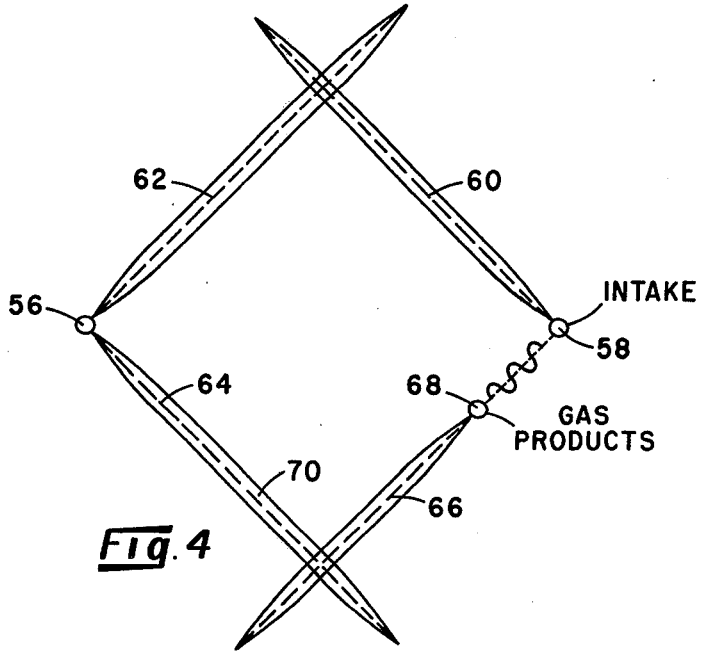
Figure 5:
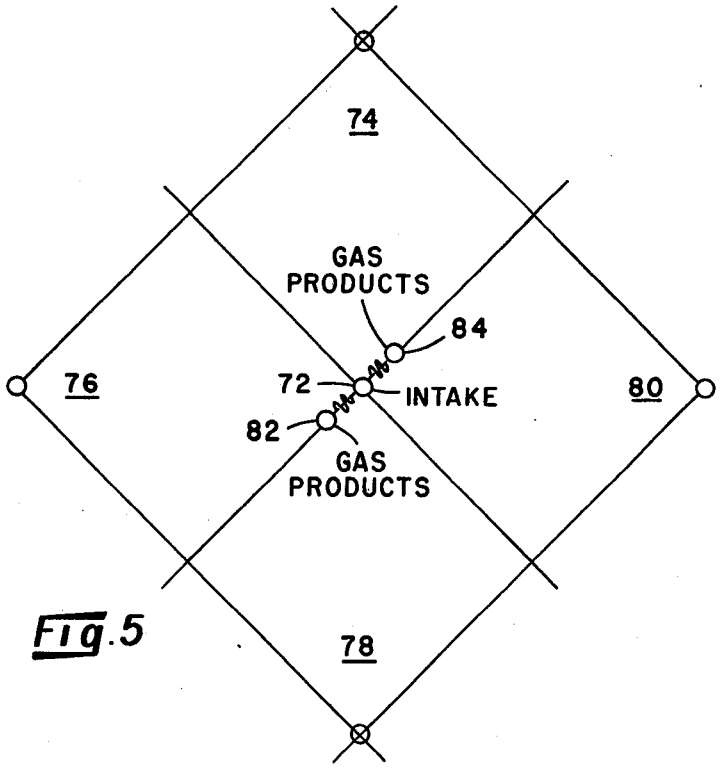

In the accompanying drawings:

FIG. 1 is a highly schematic perspective view showing an application of the directional drilling method of the present invention as may be used in the in situ gasification of a subterranean coal bed;

FIGS. 2 and 3 are schematic views showing variations of drilling patterns attainable in subterranean coal beds by employing the method of the present invention with the patterns shown in these figures providing a continuous tortuous channel through the coal bed so as to provide a combustion zone capable of communicating with virtually the entire underground coal bed; and FIGS. 4 and 5 show an application of the drilling pattern obainable by the present invention for gasifying entire blocks of the coal bed.

Described generally, the present invention is directed to an improvement in the method of in situ gasification of subterranean coal beds wherein the combustion-supporting gas is introduced into the coal bed through at least one bore penetrating the coal bed to support and maintain combustion of the coal and wherein the gaseous products resulting from the combustion of the coal are withdrawn therefrom through at least one other bore penetrating the coal bed at a location spaced from the first bore. The improvement afforded by the present invention is provided prior to the combustion of the coal bed and comprises the steps of interconnecting the first and second-mentioned bores by directing a collimated monochromatic light beam into the coal bed with the light beam having sufficient energy to effect penetration of the coal bed to interconnect the two bores by an elongated pilot bore or hole within the coal bed. The elongted pilot bore may follow a tortous path defined by a series of straight serially-connected pilot bore segments or follow a straight-line path between the two bores. After completing the formation of this pilot bore, it may be enlarged by fracturing the coal bed defining the walls of the pilot bore for facilitating the establishment of a combustion zone.

In order to provide the pilot bores for interconnecting the spaced-apart boreholes in accordance with the present invention, a laser beam generator is inserted in or the light beam therefrom is directed into a borehole in registry with the coal bed. The monochromatic light beam emanating from the laser generator is then reflected into the coal bed to effect penetration thereof by the absorption of energy in the light beam by the coal which, in turn, liquefies and/or gasifies the contacted coal to form the elongated bore. A suitable laser system employable in the practice of the present invention is described in applicant's copending application Ser. No. 624,029, filed Oct. 20, 1975, and entitled "Method For Laser Drilling Subterranean Earth Formations." In applicant's copending application, the laser drilling of subsurface earth formations is provided by pressurizing the laser-containing boreholes penetrating the earth formation with a gas transparent to the light beam and at a pressure sufficiently greater than the pore pressure in the earth formation contiguous to the borehole so as to force fluids generated by the absorption of the light beam into pores and fissures in the earth formation contiguous to the light beam. Also, the light beam may be pulsed at various frequencies so as to thermally stress the surrounding earth formation and thereby enhance the formation of fractures of fissures therein so as to provide openings into which the high pressure gas may force the gases and liquid resulting from the drilling operations into the earth formation.

As shown in FIG. 1, a subterranean coal bed which may be bituminous, sub-bituminous, or lignite is generally shown at 10. This coal bed, for the purpose of this invention, is preferably in the range of about 50 to 5,000 feet below the surface and about 2 to 100 feet in thickness. The energy and chemical values present in this coal bed can be extracted by in situ gasification by employing the method of the present invention. As shown, a first pair of boreholes 12 and 14 are drilled into the coal bed and preferably cased and cemented to the surface of the coal bed in accordance with conventional practice. These boreholes 12 and 14 are spaced apart from one another a distance in the range of about 50 to 500 feet with each subsequent set of boreholes 12 an 14 separated from the next set of boreholes a distance of about 25 to 200 feet. To practice the method of the present invention a laser beam is directed into borehole 14 and reflected into the coal bed to provide a laser-drilled pilot bore or hole 16 for interconnecting the boreholes 12 and 14. Upon completion of this laser-drilled pilot hole 16, a suitable fracturing fluid or liquid explosive may be pumped into the pilot hole 16 for providing an enlarged passageway 18 interconnecting the boreholes 12 and 14. Upon completion of the passageway 18 or any other suitable time thereafter, the coal bed contiguous to this passageway 18 may be gasified by initiating combustion therein in any suitable manner, such as propane igniters, electrical resistance igniters, or the use of propellants. With the establishment of this combustion zone 20, the combustion-supporting medium may be introduced to either borehole 12 or 14 with the product gas being withdrawn from the other borehole, cleaned, filtered, and conveyed to a storage facility or point of use. Alternatively, the combustion-supporting gas may be introduced from a suitable source 22 into the coal bed from an adjacent set of boreholes 12 and 14 with the combustion-supporting gas permeating through the coal bed from passageway 18 into combustion zone 20. This latter arrangement may be advantageous from an economic standpoint, better gas quality, and recovery efficiency, and to ensure the uniform propagation of the combustion zone from the first set of boreholes 12 and 14 to the second set of boreholes 12 and 14. Upon the arrival of the combustion zone at the second set of boreholes which contains the passageway 18, as shown, the burn front may then proceed towards the boreholes 12 and 14 shown being interconnected by the pilot hole 16. This pilot hole is preferably completed and fractured prior to the burn front reaching passageway 18. The serial drilling and combustion of the coal bed, as shown in FIG. 1, provides a highly efficient technique for extracting the energy values from the coal and may be readily achieved regardless of anomalies or directional characteristics of the coal bed.

Referring now to FIGS. 2 through 5, the drilling schemes shown provide for the in situ gasification of coal in a continuous stream manner over a tortuous path in the coal bed. The arrangement of the laser-drilled passageways through the coal bed extending from the combustion-supporting gas intake borehole to the gas product-gas retrieving borehole may be in any selected array of straight-line bore segments through the coal bed. For example, as shown in FIG. 2, a rectangular configuration is provided by utilizing a plurality of boreholes a shown at 24, 26, 28, 30, 32, 34, 36, and 38. The initial segment 40 of the laser pilot hole is laser-drilled between holes 26 and 24 and then a second pilot hole segment 42 may be drilled between 26 and 28 at a right angle to the first pilot hole segment. This pilot hole drilling operation is continued at angles of 90° to one another until the pilot hole extends as series of straight-line segments between the air intake 24 and the gas product retrieving borehole 38. Upon completion of the laser pilot drilling, the boreholes between the air intake and product retrieving boreholes 24 and 38 are plugged and the pilot hole segments fractured to provide a continuous tortuous passageway in the coal bed which is disposed in planes parallel and perpendicular to the plane of maximum permeability through the coal bed. The in situ gasification of the coal then proceeds in a stream effect in the combustion zone 44 extending between the two boreholes 24 and 38 so as to gasify essentially the entire coal bed lying therebetween. This stream effect over a tortuous path is a highly efficient method for gasification in that the only pressure required of the combustion-supporting gas is that necessary to overcome the pressure drop due to the channel flow throughout the combustion zone 44. Thus, virtually all the air or other combustion-supporting medium injected at the intake borehole will be utilized since the gas follows the path of least resistance created by the continuous channel.

This tortuous-path layout of the combustion zone 44 also provides a satisfactory method for controlling or minimizing roof collapse due to the gasification removal of the coal underlying the earth formation above the coal bed. For example, in the arrangement shown in FIG. 2, the gasification may proceed until only thin seams of coal remain in the combustion zone segments so as to provide sufficient support for the overlying earth formations. Also, the rectangular combustion zone configuration shown in FIG. 2 provides for efficient flow and extraction of the products from the coal bed by positioning the tortuous combustion zone along planes parallel to and at 90° to the plane of maximum permeability in the coal bed.

In FIG. 3, another variation of a tortuous combustion zone configuration is shown with the laser pilot holes following a generally sawtooth pattern at angles of approximately 45° to one another. In such an arrangement the 45° angle of the combustion zone segments to the plane of maximum permeability is advantageous because fewer vertical boreholes are required. Also, due to the structure of some coal, fragmentation from the overburden stress will enhance penetration and the gasification process. To further provide field development of the coal bed one or more additional sets of angular pilot holes may be provided. The positioning of the additional pilot hole sets may be conveniently achieved by offsetting the additional pilot holes at approximately half the distance between the points of intesection of the pilot holes in the adjacent set of pilot holes. This off-set arrangement may be continued across the entire coal field or any selected portion thereof. As shown in FIG. 3, a borehole is provided at the end of each pilot hole segment so as to provide a location for inserting the laser generator to extend the pilot hole in the opposite direction at a selected angle to the first pilot hole segment. However, since the use of the laser drilling system provides a highly accurate technique of orienting and directing the pilot holes, it is possible to eliminate some of the boreholes. For example, the borehole shown at 46 may be utilized to provide the pilot hole segments 48 and 50 while the borehole 52 may provide a pilot hole segment 54 which interconnects with hole 50 at the tip thereof, thereby obviating the need for a borehole at the segment intersection. Also, it may be desirable to project the pilot hole segments slightly beyond the points of intersection so as to assure that the segments will be satisfactorily coupled when fractured.

FIGS. 4 and 5 show still a further arrangement of a continuous stream removal techniques of the present method for effecting block removal of entire sections of the coal bed. In the arrangement shown, a pair of vertical boreholes 56 and 58 are disposed at spaced-apart locations in the coal bed. The laser pilot holes are then drilled towards one another at any desired angle up to about70°. These pilot holes 60, 62, 64, and 66 are drilled at the same level in the coal bed so as to intersect one another at a point intermediate the boreholes 56 and 58. As shown, an additional borehole 68 may then be drilled at a location near borehole 58 and the segment of the pilot hole extending between the new borehole 68 and 58 grouted in any suitable well-known manner. This grouting takes place prior to the fracturing of the pilot holes so as to provide a combustion-supporting medium input location at borehole 58 with a continuous stream combustion zone 70 projecting on a circuitous path to borehole 68. Alternatively, the grouting step may be eliminated by utilizing borehole 68 for providing the pilot hole 66. With the arrangement shown in FIG. 4, the total field development requires only three vertical boreholes to gasify large blocks of coal by utilizing the continuous stream method with complete directional control of the combustion zone 70 being provided by laser drilling the pilot holes.

In FIG. 5 a further expansion of the FIG. 4 arrangement is shown for providing greater block development whereby four individual blocks may be gasified by employing only five vertical holes. To form this multi-block arrangement pilot holes in the array shown in FIG. 4 may be initially drilled and then a centrally-disposed borehole 72 is provided so that radially extending pilot holes may be drilled at angles 90° apart from one another to intersect the laser pilot holes extending around the periphery of the central hole 72. With this interception of laser holes, the block is, in effect, divided into four discrete blocks 74, 76, 78 and 80. With the completion of these laser drilling steps, two of the laser-drilled pilot bores may be penetrated by additional vertical boreholes 82 and 84 with the portions of pilot holes extending between boreholes 82 and 84 and the central borehole 72 grouted. The entire pilot bore scheme about the four blocks is then fractured as described above. The gasification of the coal within the confines of the blocks may then be achieved by utilizing the central borehole 72 as the combustion-supporting medium intake with the combustion-supporting medium flowing about the tortuous path provided by the laser-drilled passageways and with the resulting combustion products being withdrawn from the coal bed via boreholes 82 and 84. With this arrangement, it may be desirable to use the boreholes 82 and 84 as well as the boreholes about the periphery of the blocks for flow control so as to provide a mechanism for regulating the propagation of the combustion zone.

While the present invention is described as being directed to in situ gasification of subsurface coal, it will be understood that the directional drilling method described herein may be utilized to provide starter boreholes for fracturing procedures and retorting such as required for oil shale operations. Also, the laser drilling techniques described herein may be utilized for dewatering and demethanizing purposes which will considerably increase the efficiency and safety of coal removal as commonly used in other mining techniques. In fact, this demethanization of coal beds prior to mining may be one of the more useful applications of the subject method. In such demathanizing operations it may be advantageous to use drilling patterns in the configuration of "stars" or "wagonwheels" so that major permeability channels of the coal bed can be intersected for effecting thorough methane drainage from large coal blocks of up to several hundred feet radius by using a single wellbore. Further, while the aforementioned laser drilling has been described primarily as relating to a two-dimensional scheme wherein a pancake-like coal bed is separated by top and bottom planes of relatively impermeable media, the method of the present invention is equally applicble to coal beds of several hundred feet thickness wherein holes may be laser drilled in such a manner as to define 3-dimensional solid blocks of various configurations, such as cubes, tetrahedrons, parallel-opipeds, prisms, pyramids or frustums thereof, etc.

What is claimed is:

1. An improvement in the method of in situ gasification of a subterranean coal bed wherein combustion-supporting gas is introduced into the coal bed through at least one bore penetrating the coal bed to support and maintain combustion of the coal and wherein gaseous products resulting from the combustion are withdrawn from the coal bed through at least one other bore penetrating the coal bed at a location spaced from the first-mentioned bore, said improvement comprising the steps prior to the combustion of the coal of interconnecting the first and second bore by directing a beam of collimated monochromatic light beam into the coal bed with said light beam having sufficient energy to effect penetration of the coal bed and the formation of an elongated bore projecting between the first and second bore along a tortuous path defined by a plurality of straight serially-connected bore segments, and thereafter enlarging the elongated bore by fracturing the coal bed defining the walls of the elongated bore.

* * * * *